US008113000B2

(12) United States Patent
Laster et al.

(10) Patent No.: US 8,113,000 B2
(45) Date of Patent: Feb. 14, 2012

(54) FLASHBACK RESISTANT PRE-MIXER ASSEMBLY

(75) Inventors: Walter R. Laster, Oviedo, FL (US); Domenico Gambacorta, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 666 days.

(21) Appl. No.: 12/210,354

(22) Filed: Sep. 15, 2008

(65) Prior Publication Data

US 2010/0064691 A1 Mar. 18, 2010

(51) Int. Cl.
*F23R 3/14* (2006.01)
*F23R 3/44* (2006.01)

(52) U.S. Cl. ..... 60/737; 60/747; 60/748; 60/39.11

(58) Field of Classification Search ..... 60/737, 60/746, 747, 748, 39.091, 39.094
See application file for complete search history.

(56) References Cited

U.S. PATENT DOCUMENTS 4,187,674 A * 2/1980 Richardson ..... 60/748
5,235,814 A 8/1993 Leonard
5,253,478 A * 10/1993 Thibault et al. ..... 60/733
5,592,819 A * 1/1997 Ansart et al. ..... 60/737
5,675,971 A * 10/1997 Angel et al. ..... 60/737
5,943,866 A 8/1999 Lovett et al.
6,038,861 A 3/2000 Amos et al.
6,038,864 A 3/2000 Prade et al.
6,068,467 A 5/2000 Mandai et al.
6,082,111 A 7/2000 Stokes
6,164,055 A 12/2000 Lovett et al.
6,415,594 B1 7/2002 Durbin et al.
6,705,087 B1 * 3/2004 Ohri et al. ..... 60/748
6,742,338 B2 6/2004 Tanaka et al.
6,786,047 B2 9/2004 Bland et al.
6,848,260 B2 2/2005 North et al.
6,925,809 B2 8/2005 Mowill
6,931,853 B2 8/2005 Dawson
7,013,648 B2 3/2006 Griffin et al.
2001/0052229 A1 12/2001 Tuthill et al.
2002/0014078 A1 2/2002 Mandai et al.
2005/0268617 A1 * 12/2005 Amond et al. ..... 60/737
2006/0174625 A1 8/2006 Ohri
2007/0000228 A1 * 1/2007 Ohri et al. ..... 60/748

* cited by examiner

*Primary Examiner* — Ted Kim

(57) ABSTRACT

A pre-mixer assembly associated with a fuel supply system for mixing of air and fuel upstream from a main combustion zone in a gas turbine engine. The pre-mixer assembly includes a swirler assembly disposed about a fuel injector of the fuel supply system and a pre-mixer transition member. The swirler assembly includes a forward end defining an air inlet and an opposed aft end. The pre-mixer transition member has a forward end affixed to the aft end of the swirler assembly and an opposed aft end defining an outlet of the pre-mixer assembly. The aft end of the pre-mixer transition member is spaced from a base plate such that a gap is formed between the aft end of the pre-mixer transition member and the base plate for permitting a flow of purge air therethrough to increase a velocity of the air/fuel mixture exiting the pre-mixer assembly.

13 Claims, 5 Drawing Sheets

FLASHBACK RESISTANT PRE-MIXER ASSEMBLY

This invention was made with U.S. Government support under Contract Number DE-FC26-05NT42644 awarded by the U.S. Department of Energy. The U.S. Government has certain rights to this invention.

FIELD OF THE INVENTION

The present invention relates to a fuel injector system in a gas turbine engine, and more particularly, to a fuel injector system including a flashback resistant pre-mixer assembly.

BACKGROUND OF THE INVENTION

In gas turbine engines, compressed air discharged from a compressor section and fuel introduced from an external source are mixed together and burned in a combustion section. The mixture is directed through a turbine section, where the mixture expands to provide rotation of a turbine rotor. The turbine rotor may be linked to an electric generator, wherein the rotation of the turbine rotor can be used to produce electricity in the generator.

Gas turbine engines are known to produce an exhaust stream containing a number of combustion products. Many of these byproducts of the combustion process are considered atmospheric pollutants, and increasingly stringent regulations have been imposed on the operation of gas turbine power plants in an effort to minimize the production of these gasses. Of particular concern is the regulation of the production of the various forms of nitrogen oxides collectively known as $NO_x$. It is known that $NO_x$ emissions from a gas turbine increase significantly as the combustion temperature rises. One method of limiting the production of $NO_x$ is the use of a lean mixture of fuel and combustion air, i.e. a relatively low fuel-to-air ratio, thereby limiting the peak combustion temperature to a level below the threshold for $NO_x$ production. However, higher combustion temperatures are desirable to obtain higher efficiency and reduced production of carbon monoxide.

Two-stage combustion systems have been developed that provide efficient combustion and reduced $NO_x$ emissions. In a two-stage combustion system, the majority of the fuel and air enter the pre-mixed combustion stage to reduce $NO_x$ emissions. In pre-mixed combustion, the air and fuel are mixed together in a pre-mixer assembly that is upstream of a main combustion chamber of the engine. A small diffusion stage is included for obtaining ignition and low load flame stability. In diffusion combustion, the air and fuel are mixed together and ignited in the combustion chamber.

Gas turbine engines have been designed to combust a broad range of hydrocarbon fuels, such as natural gas, kerosene, biomass gas, etc, and more recently gas turbines engines have been designed to combust syngas produced from integrated gasification combined cycle applications. The syngas has a much higher flame speed than natural gas and is more susceptible to flame flashback when applied in pre-mixed combustion. Flame flashback in the pre-mixer assembly of gas turbine engines is undesirable, as it can cause damage to the components in and around the pre-mixer assembly, i.e., the flame may anchor onto the components and may burn through them.

Specifically, flame flashback may be caused when the turbulent burning velocity of the air and fuel mixture exceeds the axial flow velocity in the pre-mixer assembly, especially in low velocity regions near the boundary layer of the pre-mixer assembly. Flame flashback can also occur in recirculation zones that are caused by abrupt changes in the area of the flow path of the air and fuel mixture, such as at an aft end of a swirler assembly of the pre-mixer assembly, which provides an exit for the air and fuel mixture from the pre-mixer assembly into the combustion chamber.

SUMMARY OF THE INVENTION

In accordance with a first aspect of the present invention, a pre-mixer assembly associated with a fuel supply system is provided for effecting a mixing of air and fuel upstream from a main combustion zone in a gas turbine engine. The pre-mixer assembly comprises a swirler assembly and a pre-mixer transition member. The swirler assembly is disposed about a fuel injector of the fuel supply system and includes a forward end defining an air inlet and an opposed aft end. The pre-mixer transition member extends from the aft end of the swirler assembly toward the main combustion zone and includes a forward end affixed to the aft end of the swirler assembly and an opposed aft end defining an outlet of the pre-mixer assembly to the main combustion zone. The aft end of the pre-mixer transition member is spaced from a base plate such that a gap is formed between the aft end of the pre-mixer transition member and the base plate. The gap permits a flow of purge air therethrough to effect an increase in a velocity of the air and fuel mixture exiting the pre-mixer assembly.

In accordance with a second aspect of the present invention, a pre-mixer assembly associated with a fuel supply system is provided for effecting a mixing of air and fuel upstream from a main combustion zone in a gas turbine engine. The pre-mixer assembly comprises a swirler assembly and a pre-mixer transition member. The swirler assembly is disposed about a fuel injector of the fuel supply system and includes a forward end defining an air inlet and an opposed aft end. The pre-mixer transition member extends from the aft end of the swirler assembly toward the main combustion zone and includes a forward end affixed to the aft end of the swirler assembly and an opposed aft end defining an outlet of the pre-mixer assembly to the main combustion zone. A plurality of apertures is formed in the swirler assembly and/or the pre-mixer transition member to allow purge air to flow therethrough. The purge air effects an increase in a velocity of the air and fuel mixture as the air and fuel mixture flows through the pre-mixer assembly proximate to a boundary layer of the pre-mixer assembly.

In accordance with yet another aspect of the present invention, a pre-mixer assembly associated with a fuel supply system is provided for effecting a mixing of air and fuel upstream from a main combustion zone in a gas turbine engine. The pre-mixer assembly comprises a swirler assembly and a pre-mixer transition member. The swirler assembly is disposed about a fuel injector of the fuel supply system and includes a forward end defining an air inlet and an opposed aft end. The pre-mixer transition member extends from the aft end of the swirler assembly toward the main combustion zone and includes a forward end affixed to the aft end of the swirler assembly and an opposed aft end defining an outlet of the pre-mixer assembly to the main combustion zone. The aft end of the pre-mixer transition member is spaced from a base plate such that a gap is formed between the aft end of the pre-mixer transition member and the base plate. The gap permits a flow of purge air therethrough to effect an increase in a velocity of the air and fuel mixture exiting the pre-mixer assembly. A plurality of apertures is formed in at least one of the swirler assembly and the pre-mixer transition member to allow additional purge air to flow therethrough. The additional purge air effects an increase in the velocity of the air and fuel mixture as the air and fuel mixture flows through the pre-mixer assembly proximate to a boundary layer of the pre-mixer assembly.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
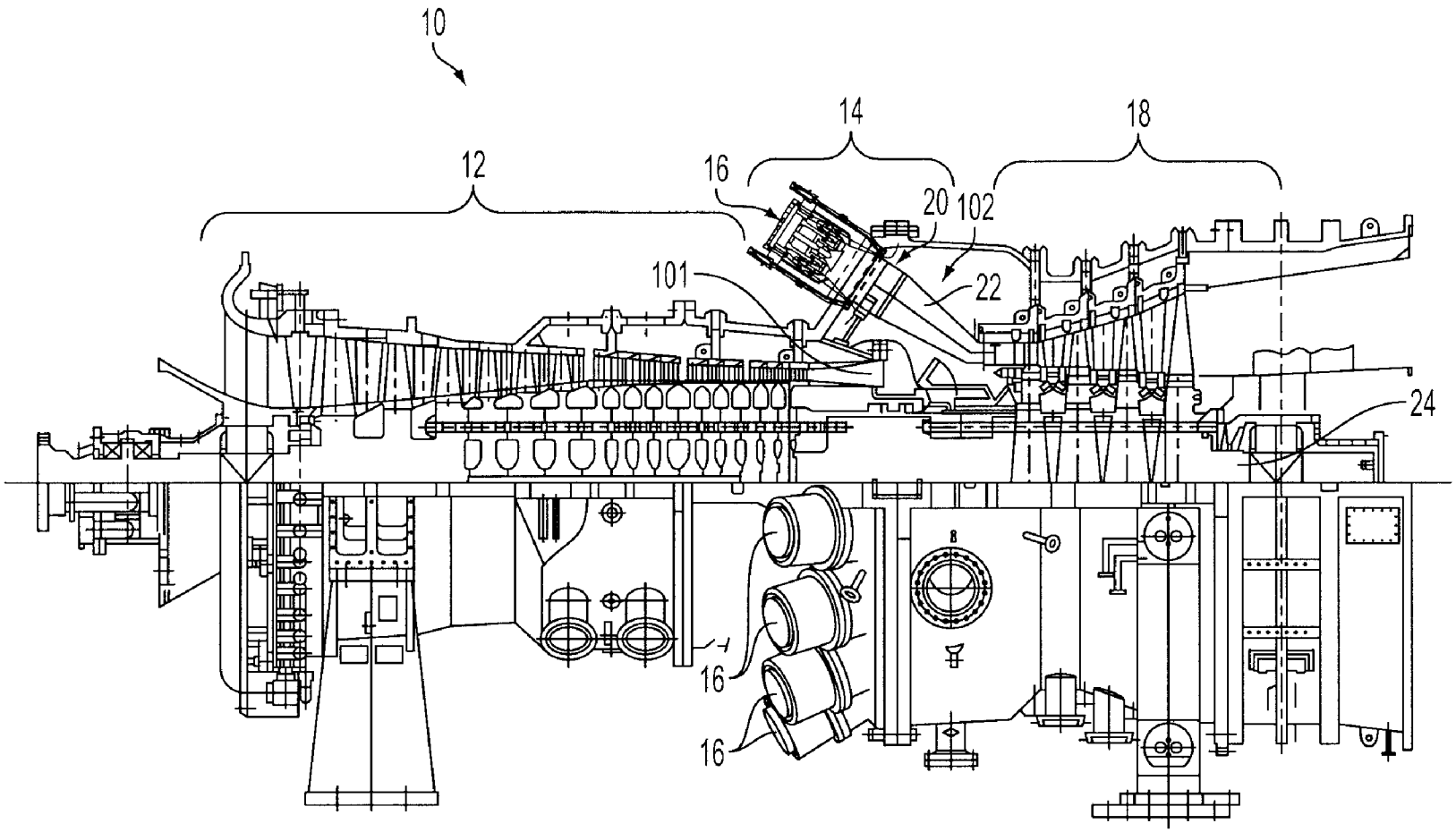
FIG. 1 is a sectional view of a gas turbine engine including a plurality of combustors incorporating pre-mixer assemblies according to an embodiment of the invention.

Referring to FIG. 1, a gas turbine engine 10 is shown. The engine 10 includes a compressor section 12, a combustion section 14 including a plurality of combustors 16, and a turbine section 18. The compressor section 12 inducts and pressurizes inlet air which is directed to the combustors 16 in the combustion section 14. Upon entering the combustors 16, the compressed air from the compressor section 12 enters a head end 19 of each of the combustors 16 and is thereafter mixed with a fuel and ignited in a main combustion zone 14A defined in an inner volume of a liner 20 (see FIG. 2) to produce a high temperature and high velocity combustion gas flowing in a turbulent manner. The combustion gas then flows from the main combustion zone 14A through a transition 22 to the turbine section 18 where the combustion gas is expanded to provide rotation of a turbine rotor 24.

Figure 2:
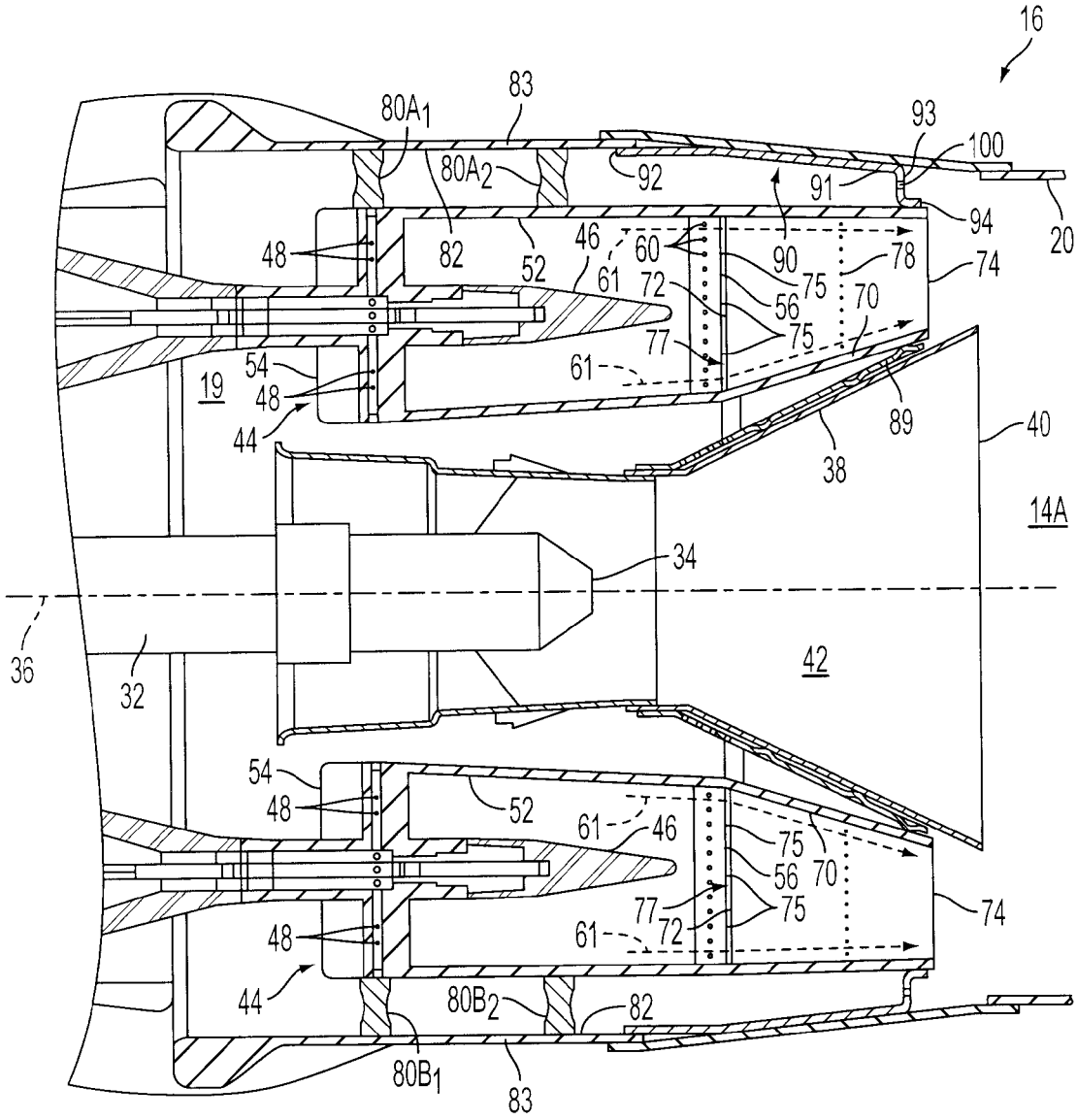
FIG. 2 is a side cross sectional view of a portion of one of the combustors illustrated in FIG. 1 incorporating a plurality of pre-mixer assemblies.

Referring to FIG. 2, a portion of one of the combustors 16 of the combustion section 14 is shown. It is understood that the remaining combustors 16 are substantially similar to the combustor 16 as described in detail herein. The combustor 16 further comprises a pilot nozzle 32 having a pilot fuel injection port 34 disposed along central axis 36 of the combustor 16 upstream from the main combustion zone 14A. The pilot nozzle 32 is in communication with a source of fuel (not shown) for delivering fuel to pilot fuel injection port 34. The pilot nozzle 32 is secured to a support housing (not shown) of the combustor 16. A pilot cone 38 having an aft end portion 40 is disposed about the pilot fuel injection port 34 of the pilot nozzle 32. A pilot flame zone 42 is formed within the pilot cone 38 adjacent and upstream from the main combustion zone 14A.

A plurality of pre-mixer assemblies 44 extend in an annular array about and are substantially parallel to the pilot nozzle 32. The pre-mixer assemblies 44 are associated with main fuel injectors 46, each having at least one and preferably a plurality of main fuel injection ports 48 as shown in FIG. 2. The main fuel injectors 46 are affixed to and extend from the support housing. The main fuel injectors 46 are in communication with a source of fuel (not shown) for delivering fuel to the pre-mixer assemblies 44. It is understood that the pilot nozzle 32 may be in communication with the same or a different source of fuel as the main fuel injectors 46.

Figure 3:
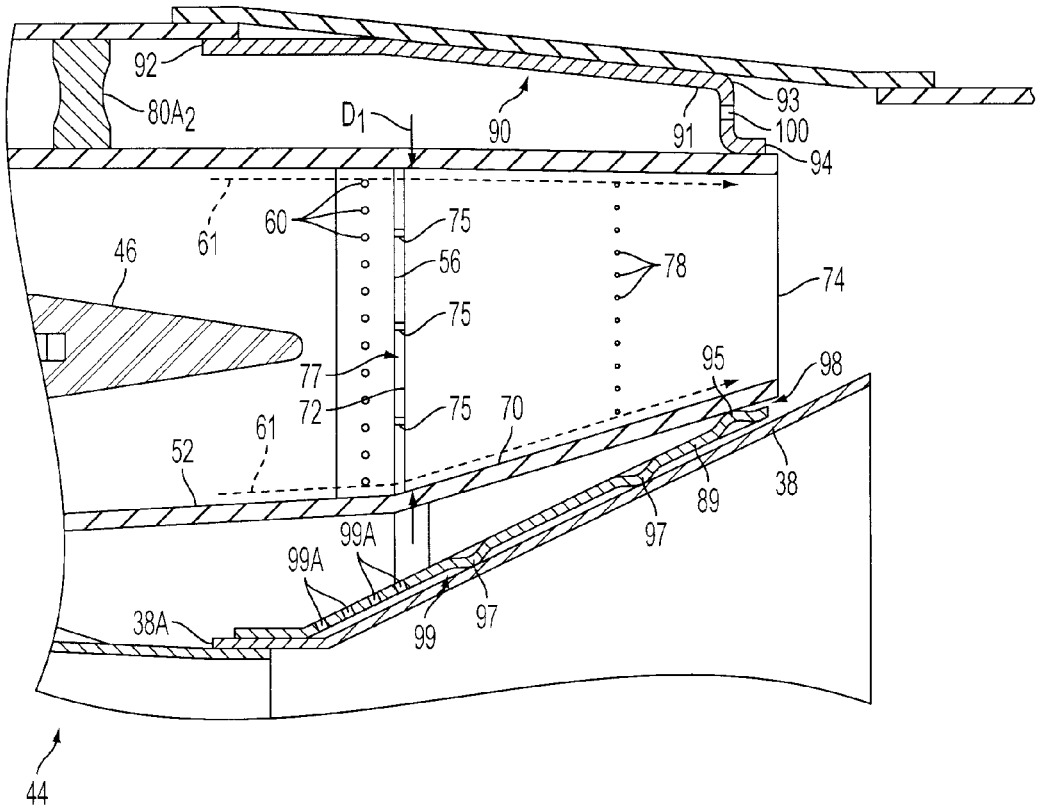
FIG. 3 is an enlarged side cross sectional view of a portion of one of the pre-mixer assemblies illustrated in FIG. 2.

Referring now to FIG. 3, one of the pre-mixer assemblies 44 will now be described. It is understood that the other pre-mixer assemblies 44 are substantially similar to the pre-mixer assembly 44 as described herein. The pre-mixer assembly 44 comprises a substantially cylindrical swirler assembly 52 having a forward end 54 (see FIG. 2) and an opposed aft end 56. Although the swirler assembly 52 illustrated herein is substantially cylindrical in shape, it is understood that the swirler assembly 52 may have any suitable shape, such as, for example, oval or polygonal. The forward end 54 defines an air inlet for receiving a flow of compressed air from the head end 19 of the combustor 16.

The swirler assembly 52 includes a plurality of apertures 60 formed near the aft end 56 thereof for permitting a flow of purge air therethrough, i.e., air from the head end 19 of the combustor 16, from the outside of the swirler assembly 52 to the inside of the swirler assembly 52. The apertures 60 are preferably aligned in at least one annular row as shown in FIGS. 2 and 3 and are sized to allow a desired amount of purge air to flow therethrough. In the preferred embodiment, the apertures 60 comprise openings having a diameter of about 2 mm, but may have other suitable sizes. The purge air effects an increase in the velocity of the air and fuel mixture flowing proximate to a boundary layer 61 of the pre-mixer assembly 44, i.e., an area proximate to the inner surface of the pre-mixer assembly 44 as will be described in greater detail below.

The pre-mixer assembly 44 also comprises a pre-mixer transition member 70, which, in the embodiment shown, comprises a separate piece from the swirler assembly 52 but may comprise a single or integral piece with the swirler assembly 52. The pre-mixer transition member 70 comprises a forward end 72 that is affixed to the aft end 56 of the swirler assembly 52 and an opposed aft end 74 defining an outlet of the pre-mixer assembly 44 to the main combustion zone 14A. As shown more, clearly in FIG. 3, spanning members 75 may be disposed between the swirler assembly 52 and the pre-mixer transition member 70 such that a gap 77 is formed therebetween. The gap 77 permits an additional flow of purge air therethrough i.e., from the head end 19 of the combustor 16 to the inside of the pre-mixer assembly 44. The additional purge air effects a further increase in the velocity of the air and fuel mixture flowing through the pre-mixer assembly 44 proximate to the boundary layer 61 as will be described in greater detail below.

The forward end 72 of the pre-mixer transition member 70 comprises a substantially cylindrical opening having a dimension $D_1$ of about 2.8 inches (see FIG. 3) and the aft end 74 comprises a circumferentially elongated and radially compressed opening having a circumferential dimension $D_2$ of about 1.6 inches (see FIG. 4) and a radial dimension $D_3$ of about 3.7 inches. The pre-mixer transition member 70 narrows radially and expands circumferentially from the forward end 72 to the aft end 74 thereof to form the circumferentially elongated and radially compressed opening shown in FIG. 4, such that the aft end 74 of each pre-mixer transition member 70 comes into close proximity with the aft end 74 of the two adjacent pre-mixer transition members 70.

The pre-mixer transition member 70 includes a plurality of apertures 78 formed therein for permitting an additional flow of purge air therethrough i.e., from the head end 19 of the combustor 16 to the inside of the pre-mixer transition member 70, as shown in FIGS. 2 and 3. The apertures 78 are preferably aligned in at least one annular row as shown in FIGS. 2 and 3 and are sized to allow a desired amount of additional purge air to flow therethrough. In the embodiment shown, the apertures 78 comprise openings having a diameter of about 1 mm, and in a preferred embodiment are smaller than the apertures 60 formed in the swirler assembly 52. Preferably, the apertures 78 formed in the pre-mixer transition member 70 are circumferentially staggered from the apertures 60 formed in the swirler assembly 52. The additional purge air effects a further increase in the velocity of the air and fuel mixture flowing through the pre-mixer assembly 44 proximate to the boundary layer 61 as will be described in greater detail below.

As shown in FIG. 2, pins 80$A_1$, 80$A_2$, 80$B_1$, 80$B_2$ secure the pre-mixer assemblies 44 to a radially inner surface 82 of a liner head 83 that is affixed to the liner 20, such as, for example, by welding. The pins 80$A_1$, 80$A_2$, 80$B_1$, 80$B_2$ may comprise, for example, hourglass shaped or straight members that are welded or otherwise secured at one end to the radially inner surface 82 of the liner head 83 and at the other end to the corresponding pre-mixer assembly 44. Any suitable number of pins 80$A_1$, 80$A_2$, 80$B_1$, 80$B_2$ may be used for attachment of the pre-mixer assemblies 44 to the liner 20.

Figure 4:
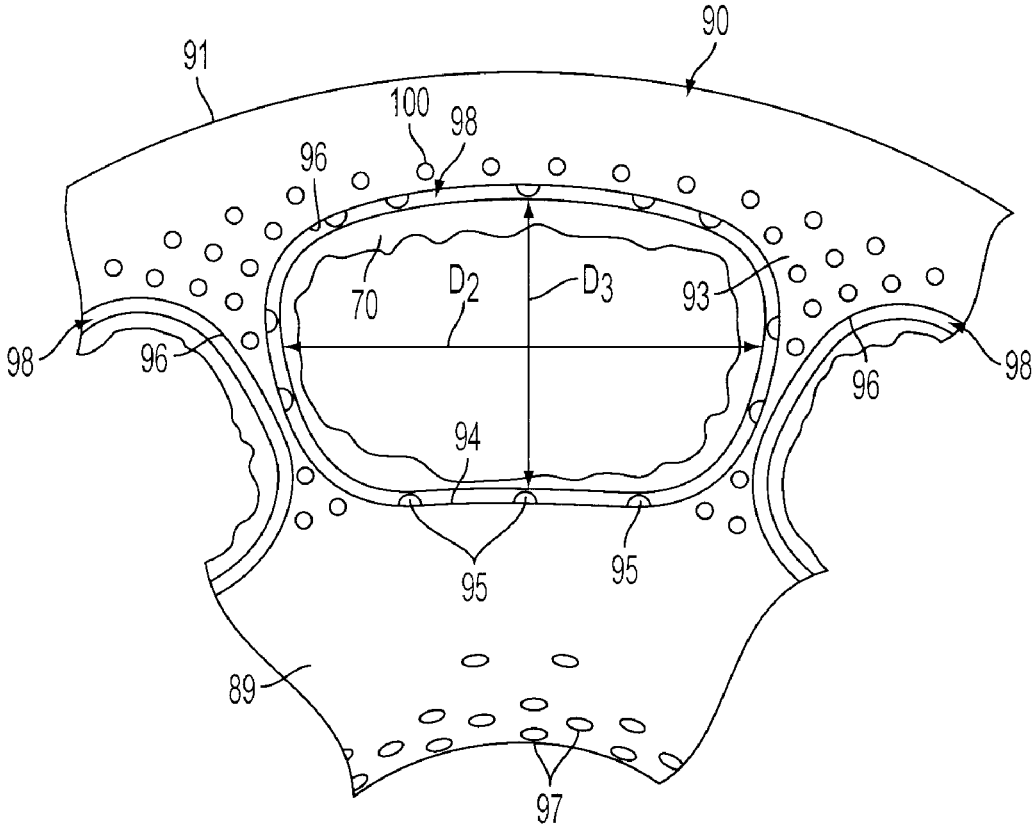
FIG. 4 is an end view of a portion of the pre-mixer assembly shown in FIG. 3 illustrating a base plate according to an embodiment of the invention.

Referring now to FIGS. 2-4, a base plate 90 of the combustor 16 is shown. It is understood that each of the combustors 16 includes a base plate 90 that is substantially similar to the base plate 90 described in detail herein. The base plate 90 comprises a radially inner wall 89 that surrounds the pilot cone 38 and a radially outer wall 91 proximate to the liner 20. In the embodiment shown in FIGS. 2 and 3, a forward end 92 of the radially outer wall 91 of the base plate 90 is attached to the radially inner surface 82 of the liner head 83 downstream from the pins 80A, 80B, such as by welding, for example. A radial wall 93 of the base plate 90 extends between the radially inner wall 89 and the radially outer wall 91 and defines an aft end of the base plate 90. The aft end 94 of the base plate 90 extends to an axial location slightly upstream from the axial location of the aft end 74 of the pre-mixer transition member 70, although it is understood that the aft end 94 of the base plate 90 could extend to an axial location slightly downstream from or substantially the same as the axial location of the aft end 74 of the pre-mixer transition member 70.

As shown in FIG. 4, the radial wall 93 of the base plate 90 includes a plurality of apertures 96 formed therein, each aperture 96 having a size slightly larger than the dimensions D2, D3 of the aft end 74 of the pre-mixer transition member 70, i.e., such that a gap 98 is formed between the aft end 74 of the pre-mixer transition member 70 and the radial wall 93 of the base plate 90. Each of the apertures 96 is associated with a respective one of the pre-mixer assemblies 44 of the engine 10 and permits the air and fuel mixture in each associated pre-mixer assembly 44 to flow out of the pre-mixer assembly 44 and into the main combustion zone 14A.

In the embodiment shown, the gaps 98 comprise dimensions in the radial and circumferential directions such as, for example, 1.0 mm around the circumference of the pre-mixer transition member 70 between the pre-mixer transition member 70 and the aft end 94 of the base plate 90. The gaps 98 are maintained by a plurality of first protuberances 95 formed in the base plate 90 that extend toward the pre-mixer transition members 70, as shown in FIG. 3. It is noted that since the pre-mixer transition member 70 and the aft end 94 of the base plate 90 extend to slightly different axial locations, the gaps 98 also comprise a dimension in the axial direction. It is also noted that the gaps 98 may comprise any combination of dimensions in the radial, circumferential, and/or axial directions depending on the locations of the pre-mixer transition member 70 and the aft end 94 of the base plate 90. The gaps 98 permit a flow of purge air therethrough i.e., from the head end 19 of the combustor 16 to effect an increase in the velocity of the air and fuel mixture as it exits the pre-mixer assemblies 44. The gaps 98 are maintained by a plurality of first protuberances 95 formed in the base plate 90 that extend toward the pre-mixer transition member 70, as shown in FIG. 3.

The radially inner wall 89 of the base plate 90 also includes a plurality of second protuberances 97 formed therein that extend outwardly toward the pilot cone 38, as shown in FIG. 3. The second protuberances 97 create a passageway 99 between the pilot cone 38 and the base plate 90 that allows the flow of cooling air therethrough that can be used to provide cooling for the pilot cone 38. Air from the head end 19 of the combustor 16 is permitted to flow into the passageway 99 through apertures 99A formed in the base plate 90 proximate to a forward end 38A of the pilot cone 38 as shown in FIG. 3. It is noted that this air flows out of the passageway 99 adjacent the aft end 94 of the pre-mixer transition member 70 and may be used to further increase the velocity of the air and fuel mixture exiting the pre-mixer assemblies 44 and/or prevent flame holding in this region.

As shown in FIG. 4, the base plate 90 also includes a plurality of small holes 100 having a diameter of about 1.0 mm formed in the radial wall 93 thereof for permitting additional purge air to flow therethrough i.e., from the head end 19 of the combustor 16 to prevent flame holding on the base plate 90 by further increasing the velocity of the air and fuel mixture as it exits the pre-mixer assemblies 44. It is understood that an amount of fuel, i.e., supplied from an upstream fuel injector (not shown), such as, for example, a C-stage fuel injector, may be mixed with the air flowing through the holes 100 during different operating conditions of the engine. It is understood that the fuel flow is preferably provided such that the fuel air mixture is always below the flammability limit of the mixture.

During operation of the engine 101 the compressed air from compressor section 12 flows through a compressor section exit diffuser 101 (see FIG. 1) into a combustor plenum 102 (see FIG. 1). The compressed air then flows into the head end 19 of each of the combustors 16 and into the pilot flame zone 42 where it is mixed with fuel from the pilot fuel injection port 34. The mixture of air and fuel from the pilot fuel injection port 34 then exits the pilot flame zone 42 and enters the main combustion zone 14A.

Compressed air from compressor section 12 also flows from the head ends 19 of the combustors 16 into each of the pre-mixer assemblies 44 through the forward ends 54 of the pre-mixer assembly swirler assemblies 52. The air is mixed with fuel from the main fuel injectors 46 and the air and fuel mixture flows through the swirler assemblies 52 and into the pre-mixer transition members 70.

The purge air flowing through the apertures 60 in the swirler assemblies 52 increases the velocity of the air and fuel mixture proximate to the boundary layer 61 to assist in preventing flame flashback from occurring in the pre-mixer assemblies 44, i.e., by assisting in keeping the velocity of the air and fuel mixture proximate to the boundary layer 61 above the turbulent burning velocity of the air and fuel mixture. In addition to increasing the velocity of the air and fuel mixture, this air also lowers the fuel air ratio in this region. Further, the close proximity of the forward ends 72 of the pre-mixer transition members 70 to the aft ends 56 of the swirler assemblies 52 provide for a smooth transition for the mixture of air and fuel through the pre-mixer assembly 44, thus preventing air and fuel mixture recirculation zones that could otherwise be caused by abrupt transitions in the flow path between components in the combustion section 14. Additionally, the extended structure provided by the pre-mixer transition members 70 provides a smooth flow path for the air and fuel mixture flowing out of the pre-mixer assemblies 44 to further prevent air and fuel mixture recirculation zones. Moreover, the additional purge air that flows through the gaps 77 between the swirler assemblies 52 and the pre-mixer transition members 70, and the additional purge air that flows through the apertures 78 in the pre-mixer transition members 70 provide for additional increases in the velocity of the air and fuel mixture flowing through the pre-mixer assemblies 44 proximate to the boundary layer 61 to further assist in preventing flame flashback from occurring in the pre-mixer assemblies 44.

The air and fuel mixture then flows out of the aft end 74 of the pre-mixer transition members 70 and through the apertures 96 in the base plate 90 into the main combustion zone 14A. The purge air that flows through the gaps 98 between the pre-mixer transition members 70 and the base plate 90 and the holes 100 in the base plate 90, in addition to the air flowing out of the passageways 99 between the pilot cone 38 and the base plate 90, assists in preventing flame flashback from occurring at the aft ends 74 of the pre-mixer transition members 70, i.e., by assisting in keeping the velocity of the air and fuel mixture above the turbulent burning velocity of the air and fuel mixture at the exits of the pre-mixer assemblies 44 to the main combustion zone 14A, which, in prior art configurations, are locations that are prone to the formation of flame recirculation zones and flame flashback.

It is noted that the location of the aft end 94 of the base plate 90 proximate to the aft ends 74 of the pre-mixer transition members 70 is advantageous since the sizes of the gaps 98 between the radial wall 93 of the base plate 90 and the aft ends 74 of the pre-mixer transition members 70 can be controlled for providing a desired amount of purge air therethrough to prevent flame recirculation zones from occurring at the exits of the pre-mixer assemblies 44.

It is also noted that the base plate 90 eliminates the need for an additional structure to provide cooling for the pilot cone 38. Specifically, prior art systems typically employ an outer cone that surrounds the pilot cone 38 and creates a passageway between the outer cone and the pilot cone 38 that allows the flow of cooling air therethrough, which is used to provide cooling for the pilot cone 38.

Figure 5:
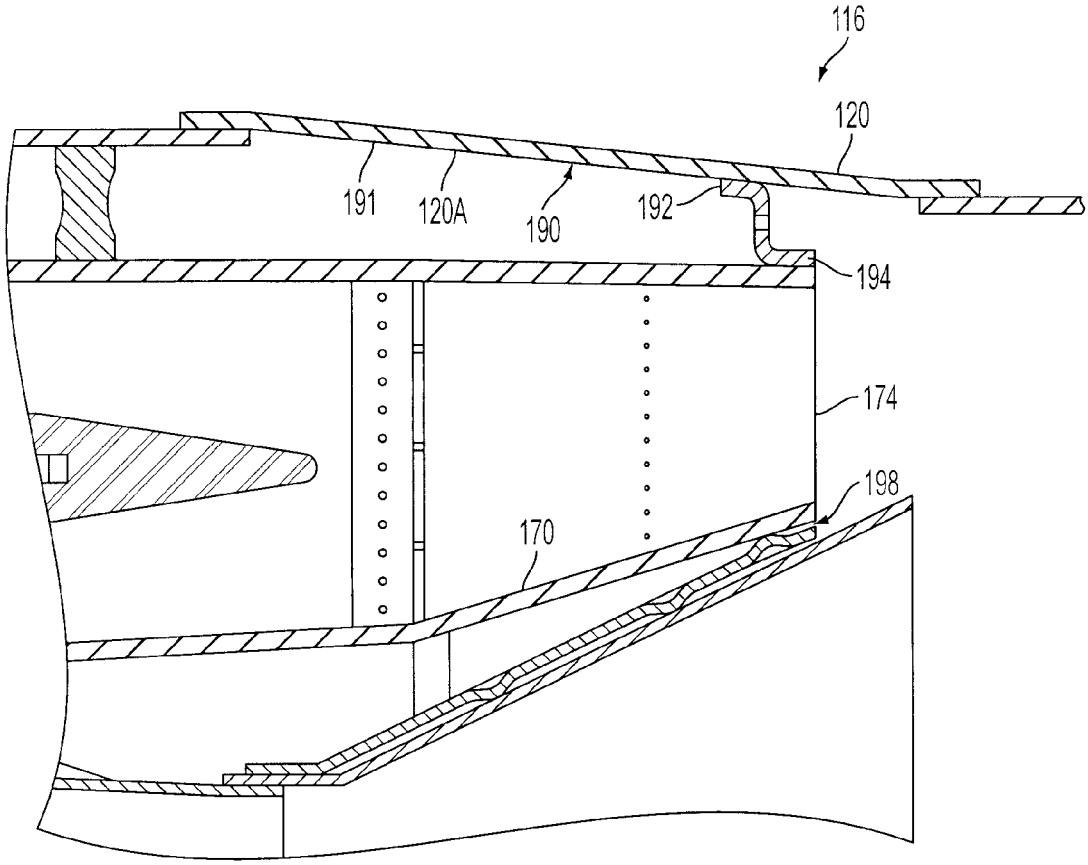
FIG. 5 is a side cross sectional view of a pre-mixer assembly and a base plate according to another embodiment of the invention.

Referring now to FIG. 5, a combustor 116 according another embodiment of the invention is shown, wherein elements corresponding to elements of the first described embodiment of the combustor 16 (FIGS. 1-4) are identified by the same reference numeral increased by 100. A base plate 190 according to this embodiment of the invention includes a radially outer wall 191 having a forward end 192 that is attached to a radially inner surface 120A of a liner 120 at a location that is axially downstream from where the forward end 92 of the base plate 90 is mounted in the embodiment described above for FIGS. 1-4. An aft end 194 of the base plate 190 extends to substantially the same axial location as an aft end 174 of a pre-mixer transition member 170, although it is understood that the aft end 194 of the base plate 190 could extend to an axial location slightly in front of or behind the aft end 174 of the pre-mixer transition member 170. It is noted that the radially outer wall 191 of the base plate 190 according to this embodiment is axially shorter in length than the length of the base plate 90 described above for FIGS. 1-4, which accounts for the difference in mounting locations between the base plates 90, 190 while maintaining the same axial location of the aft ends 94, 194 of the respective base plates 90, 190.

As with the base plate 90 described above for FIGS. 1-4, gaps 198 are formed between the aft ends 174 of the pre-mixer transition members 170 and the aft end 194 of the base plate 190. In the embodiment shown in FIG. 5, the gaps 198 comprise dimensions in the radial and circumferential directions such as, for example, 1.0 mm around the circumferences of the pre-mixer transition members 170 between the pre-mixer transition members 170 and the aft end 194 of the base plate 190. However, it is understood that the gaps 198 could comprise a dimension in the axial direction, instead of or in addition to the dimensions in the radial and circumferential directions depending on the locations of the aft ends 174 of the pre-mixer transition members 170 and the aft end 194 of the base plate 190. The gaps 198 permit a flow of purge air therethrough to effect an increase in a velocity of the air and fuel mixture exiting the pre-mixer assemblies 144.

The remaining structure of the combustor 116 and use thereof is substantially the same as for the combustor 16 described above for FIGS. 1-4.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fuel supply system in a gas turbine engine, the fuel supply system comprising:

a plurality of main fuel injectors surrounding a center pilot nozzle; and a plurality of pre-mixer assemblies, each pre-mixer assembly associated with a respective one of said main fuel injectors, said pre-mixer assemblies for effecting a mixing of air and fuel upstream from a main combustion zone in the gas turbine engine, each pre-mixer assembly comprising:

a swirler assembly disposed about said respective main fuel injector, said swirler assembly including a forward end defining an air inlet and an opposed aft end;

a pre-mixer transition member extending from said aft end of said swirler assembly toward the main combustion zone, said pre-mixer transition member including a forward end affixed to said aft end of said swirler assembly and an opposed aft end defining an outlet of said pre-mixer assembly to the main combustion zone, wherein said aft end of said pre-mixer transition member is spaced from a base plate such that a gap is formed between said aft end of said pre-mixer transition member and said base plate, said gap permitting a flow of purge air therethrough to effect an increase in a velocity of the air and fuel mixture exiting said pre-mixer assembly;

wherein a plurality of apertures is formed in each of said swirler assembly and said pre-mixer transition member to allow additional purge air to flow therethrough, said additional purge air for effecting an increase in said velocity of the air and fuel mixture as the air and fuel mixture flows through said pre-mixer assembly proximate to a boundary layer of said pre-mixer assembly; and wherein said apertures formed in said pre-mixer transition member have a smaller diameter than a diameter of said apertures in said swirler assembly.

2. The fuel supply system according to claim 1, wherein said base plate includes an annular array of apertures formed therein, each of said apertures associated with a respective pre-mixer assembly of the engine and permits the air and fuel mixture in each associated pre-mixer assembly to flow from the respective pre-mixer assembly into the main combustion zone.

3. The fuel supply system according to claim 1, wherein a gap is formed between said swirler assembly and said pre-mixer transition member of each pre-mixer assembly to allow additional purge air to flow therethrough to effect an additional increase in said velocity of the air and fuel mixture as the air and fuel mixture flows through each pre-mixer assembly proximate to said boundary layer of each pre-mixer assembly.

4. The fuel supply system according to claim 1, wherein said apertures in at least one of said swirler assembly and said pre-mixer transition member of each pre-mixer assembly are arranged in at least one annular row.

5. The fuel supply system according to claim 1, wherein said apertures in both said swirler assembly and said pre-mixer transition member of each pre-mixer assembly are arranged in at least one annular row.

6. The fuel supply system according to claim 1, wherein said apertures formed in said pre-mixer transition member are staggered with respect to said apertures in said swirler assembly.

7. The fuel supply system according to claim 1, wherein said base plate is attached to a liner head.

8. The fuel supply system according to claim 1, wherein said base plate is attached to a radially inner surface of a liner.

9. The fuel supply system according to claim 1, wherein said pre-mixer transition member comprises a forward end radial dimension and an aft end radial dimension smaller than said forward end radial dimension.

10. The fuel supply system according to claim 1, wherein said swirler assembly and said pre-mixer transition member are integrally formed.

11. The fuel supply system according to claim 1, wherein said swirler assembly and said pre-mixer transition member are separately formed.

12. The fuel supply system according to claim 1, wherein said pre-mixer transition member and said base plate extend to about the same axial location and said gap between said pre-mixer transition member aft end and said base plate comprises a dimension in at least one of a radial direction and a circumferential direction.

13. The fuel supply system according to claim 1, further comprising a passageway formed between said base plate and a pilot cone associated with said center pilot nozzle, said passageway permitting cooling air to flow therethrough for effecting a cooling of at least one of said pilot cone and said base plate.

* * * * *